United States Patent [19]

Abrams

[11] Patent Number: 4,807,425

[45] Date of Patent: Feb. 28, 1989

[54] METHOD AND DEVICE FOR OPENING AND CLOSING VIALS

[76] Inventor: Robert S. Abrams, 21 Marion Ave., Albany, N.Y. 12203

[21] Appl. No.: 126,920

[22] Filed: Nov. 30, 1987

[51] Int. Cl.[4] ..... B65B 43/38

[52] U.S. Cl. ..... 53/468; 53/50; 53/381 A; 53/382

[58] Field of Search ..... 53/381 A, 382, 109, 53/468, 50

[56] References Cited

U.S. PATENT DOCUMENTS

| | | | |
|---|---|---|---|
| 1,862,479 | 6/1932 | Gasper . | |
| 2,273,264 | 2/1942 | Hermani | 53/382 |
| 2,379,090 | 6/1945 | LeBeau | 53/382 |
| 2,931,147 | 4/1960 | Banby | 53/381 A |
| 3,184,898 | 5/1965 | Berney . | |
| 3,545,174 | 12/1970 | Randrup | 53/381 A |
| 3,564,805 | 2/1971 | Mumford | 53/381 A |
| 3,719,023 | 3/1973 | Richardson | 53/381 A |
| 3,914,920 | 10/1975 | DiIanni . | |
| 4,030,271 | 6/1977 | Kefauver et al. . | |
| 4,363,204 | 12/1982 | Ohude et al. . | |
| 4,446,674 | 5/1984 | Inada . | |
| 4,535,585 | 8/1985 | Gardos . | |
| 4,590,745 | 5/1986 | Randles . | |
| 4,635,509 | 1/1987 | Nagao et al. . | |

OTHER PUBLICATIONS

Advertisement of Capitol Vial Inc. in "Dairy Foods", Jul. 1986-p. 105.

*Dairy and Food Sanitation,* Aug. 1986, p. 361.

*Primary Examiner*—John Sipos

*Attorney, Agent, or Firm*—Burns, Doane, Swecker & Mathis

[57] ABSTRACT

A method and device for opening and closing vials includes a rack for supporting a plurality of vials, a first arrangement for sequentially lifting a cap from each of the supported vials, an upwardly sloping bar for raising each cap from its respective vial, a downwardly sloping bar for lowering each cap onto its respective vial, and a second arrangement for closing each cap onto its respective vial.

22 Claims, 4 Drawing Sheets

METHOD AND DEVICE FOR OPENING AND CLOSING VIALS

BACKGROUND OF THE INVENTION

The present invention relates to an automatic device and a process for opening and closing vials. More particularly, the present invention relates to an automatic device and a process for opening and closing a plurality of vials in succession.

Vials of the type for which the present invention is particularly adapted are vials having a cap attached to the body portion by a hinge. The vials are generally comprised of plastic, and may range in size from 1.5 to 5 inches tall and 0.5 to 4 inches in diameter. Each vial includes a cap that seals tightly to the top of the vial and is integrally connected to the vial with a hinge that may be in the form of a folded plastic flange. FIG. 1 illustrates an example of such a plastic vial with the cap in an open position. A vial of this type is the subject of a copending U.S. patent application, Ser. No, 928,475, filed on Nov. 10, 1986.

Although the present invention is particularly adapted to the vials described in the preceding paragraph, it can also be used with other types. Such vials are frequently used to hold small samples of a liquid for testing purposes. While some testing of samples is done by manually opening and closing the vial, in order to efficiently test a large quantity of samples, an automated device for opening and closing the vials is desirable. Various types of container opening and closing devices are well known in the prior art. There are several known devices intended for manipulating caps on bottles or similar containers.

For example, U.S. Pat. No. 3,914,920, issued on Oct. 28, 1975 to Dilanni, discloses a bottle opening machine that removes caps from bottles and then inserts a tube into each bottle for extracting the contents therefrom.

U.S. Pat. No. 4,030,271, issued on June 21, 1977 to Kefauver et al. discloses an apparatus that is designed to screw on or unscrew caps from bottles or vials held in a standard rack or holder.

Other devices are known for manipulating box-type containers. For example, U.S. Pat. No. 4,590,745, issued on May 27, 1986 to Randles, discloses an apparatus that is designed for closing open flaps on a carton. The cartons are moved along a set of rails that progressively closes the flaps as each carton is moved past the rails by a conveyor system.

None of the prior art devices is adapted for sequentially opening and closing vial containers while allowing access to the vial during the period between the opening and closing of the vial.

Furthermore, none of the prior art devices provides for totally automated opening and closing of a plurality of vials having hinged caps.

In addition none of the prior art container manipulating devices are well adapted for the sealing and unsealing of caps that seal tightly onto their respective vials.

Accordingly, the prior art devices are generally not satisfactory for use with the plastic vials described above, because they do not provide a convenient and automated system for sequentially testing or otherwise manipulating the contents of a plurality of vials.

SUMMARY AND OBJECTS OF THE INVENTION

In view of the foregoing limitations and shortcomings of the prior art devices, as well as other disadvantages not specifically mentioned above, it should be clear that prior to the present invention there existed a need in the art for an improved automated system for opening and closing vials. It is therefore, a primary object of the present invention to fulfill that need by providing such a device.

More particularly, it is an object of the present invention to provide a device and a method for sequentially opening and closing a plurality of vials having caps attached thereto with hinges.

It is another object of the present invention to provide a device and method for opening and closing vials that can be incorporated onto standard types of machines such as pipette testing equipment.

It is a further object of the present invention to provide a device and a method for deflecting the cap away from the vial top in order to allow unimpeded access to the vial.

A further object of the present invention is to provide a method and apparatus for stabilizing the vials during opening and closing thereof.

A still further object is to provide a method and apparatus that facilitates indexing of the vials relative to their contents.

It is still another object of the present invention to provide a device and a method for returning the cap to the vial top after a predetermined period in order to facilitate closing the vial.

Yet another object of the present invention is to provide a device and method for securely sealing the cap onto the vial after the cap has been properly positioned with respect to the vial.

Briefly described, these and other objects are accomplished according to the invention by providing an apparatus for opening and closing caps onto vials that includes a device for supporting a plurality of vials, a device for sequentially lifting a cap from each of the supported vials, a device for raising each cap from its respective vial, a device for lowering each cap onto is respective vial, and a device for closing each cap onto its respective vial.

The present invention also relates to a method of opening and closing caps onto vials that includes locating a plurality of vials in a vial support, sequentially lifting a cap from each of the vials, sequentially raising each cap from its respective vial, sequentially lowering each cap onto its respective vial, and sequentially closing each lowered cap onto its respective vial.

In a further aspect of the present invention is a device for supporting a plurality of vials that includes a base, an upper vial supporting surface having a plurality of holes therein, a vial base supporting surface having a plurality of holes therein that are in vertical alignment with the holes in the upper vial supporting surface, and a device for preventing rotation of the vials.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION

Figure 1:
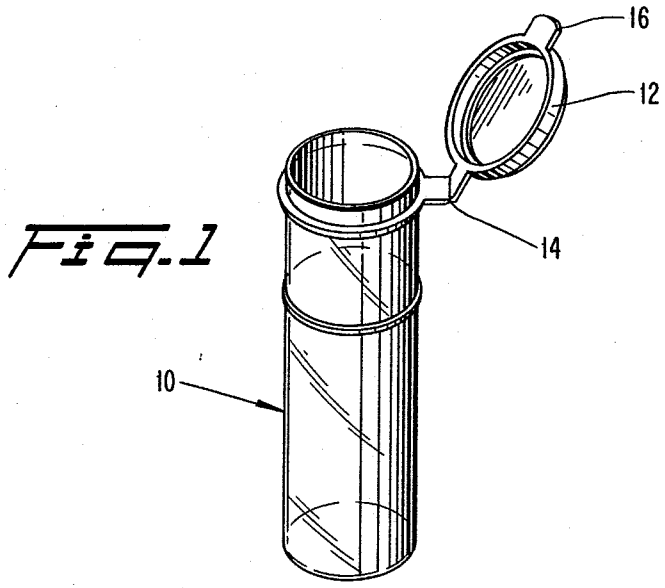
FIG. 1 is a perspective view of a representative vial and cap that is intended to be used with the present invention.

Referring now in detail to the drawings, like parts are designated by like reference numerals throughout. With reference to FIG. 1, a vial 10, usually of plastic, of the type particularly adapted for use with the present invention is shown. One such representative vial is the subject of copending U.S. patent application, Ser. No. 928,475, filed on Nov. 10, 1986, the subject matter of which is hereby incorporated by reference. However, it is to be understood that other cap and vial structures are equally adapted for use with the present invention.

A cap 12 is integrally connected to the vial 10 by a flanged hinge 14. A tab 16 projects from a portion of the edge of the cap 12 that is diametrically opposite the portion of the edge to which the hinge 14 is connected. The material from which the vial 10, cap 12 and hinge 14 are manufactured is resilient plastic.

In a preferred embodiment, the tab 16 extends from the cap 12 a distance sufficient to facilitate opening of the cap 12, approximately ¼ of an inch. The hinge 14 extends from the cap 12 a distance sufficient to permit easy movement of the cap with respect to the vial, approximately 3/16 of an inch.

The vials 10, described herein are frequently used to hold small samples of a liquid, such as milk. There is currently available automatic testing equipment that can be used to withdraw and analyze small samples of the liquid contained in the vials. Such testing equipment has a track and/or drive mechanism for moving racks of vials 10 adjacent the equipment. The equipment also includes a pipette that is repeatedly lowered into the succession of vials that is moving beneath it. A representative example of such testing equipment, shown schematically in FIGS. 4 and 5 by reference numeral 36, is manufactured by AS Foss Electric Denmark The present invention is designed to be incorporated on such testing equipment.

Figure 2:
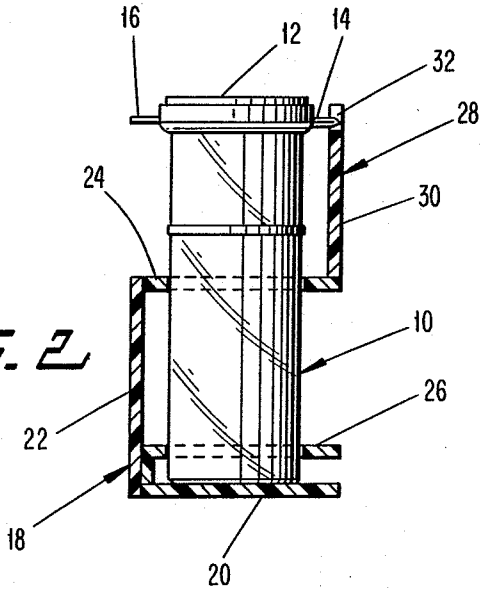
FIG. 2 is a cross-sectional view taken along line 2—2 of FIG. 3 of a rack according to the present invention having a vial in it.
Figure 3:
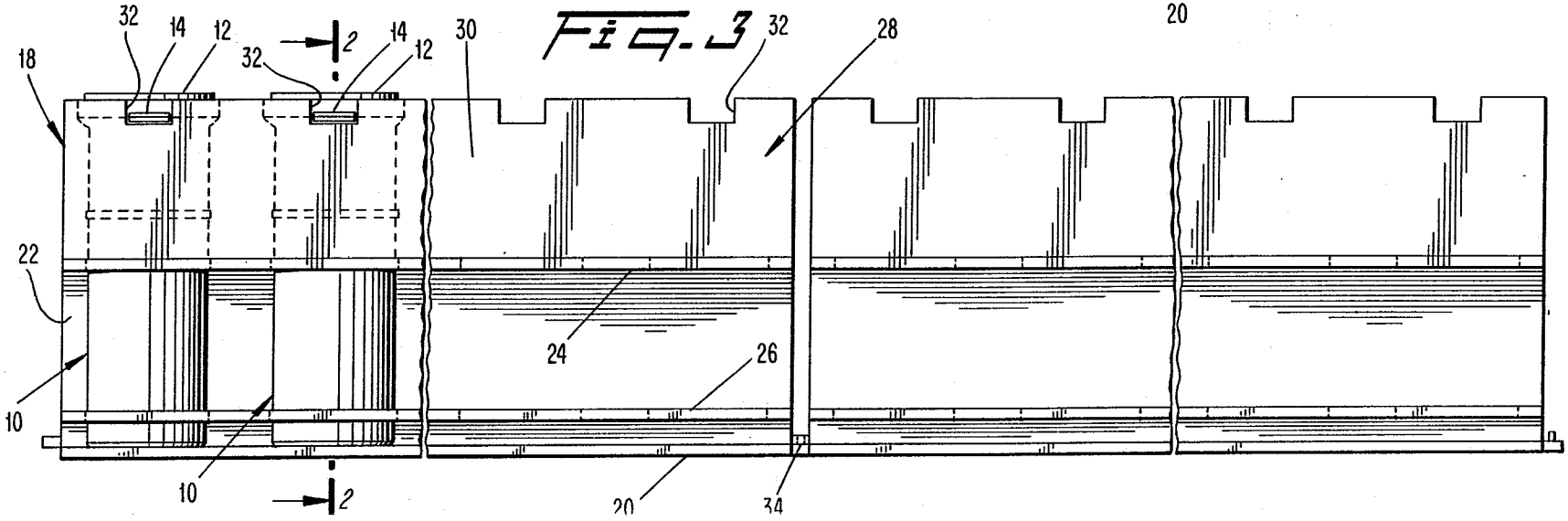
FIG. 3 is a side view of two racks according to the present invention.

With reference to FIGS. 2 and 3, specially designed racks 18 are provided to hold the above-described vials 10 for use with the present invention. Prior art racks comprise a base plate and an upper plate having a plurality of holes therein, and a support connecting the upper plate to the base plate. Each vial fits through one of the holes and is supported by the base plate.

Each rack 18 of the present invention includes a base 20, a side wall 22, an upper vial supporting surface 24, and an "L" shaped vial base support 26 for stabilizing the vial against tipping. Each of the upper vial supporting surface 24 and the vial base support 26 includes a flat surface with a series of openings therein, into which openings the individual vials 10 are placed. Extending from one edge of the upper vial supporting surface 24 is a vial hinge support 28, which includes a vertical wall 30 having a plurality of notches 32 therein. The notches 32 are arranged to correspond with the openings in the upper vial supporting surface 24 and the vial base support 26, such that the hinge 14 of a vial 10 placed in an opening in the upper vial supporting surface 24 fits within the respective notch 32 in the vial hinge support 28 for stabilizing the vial against rotation.

Although the length of the rack 18 is not critical, a preferred embodiment of the rack 18 holds twenty vials 10. At each end of each rack 18 is a linking mechanism 34, which enables a plurality of racks 18 to be linked together for a continuous feeding of racks 18 and vials 10 through the testing equipment 36.

The racks 18 are engaged by the standard drive mechanism provided with the testing equipment 36. The speed at which the racks 18 are moved through the testing equipment 36 depends on the particular testing equipment used, although the racks 18 are commonly moved at a rate of about 15–30 vials per minute. Certain models of testing equipment made by AS Foss Electric Denmark have variable speed drive mechanisms such that the speed at which the racks 18 and vials 10 move can be adjusted.

The testing equipment 36, which is of known design, includes a pipette 38 that extends over the rack 18 of vials 10. The pipette 38 movement is coordinated with the rack 18 drive mechanism so that the pipette 38 is inserted into and withdrawn from each vial 10 as it passes below the pipette 38.

In accordance with the present invention, a cam operating switch 40 is mounted adjacent the pipette 38 such that the switch 40 is triggered by the lowering of the pipette 38 into a vial 10A. A source 41 of air is connected to and controlled by the cam operating switch 40. A pneumatic tube leads from the switch 40 to a "T" connection 51, from which the air is diverted to air regulators 48,49. This air ultimately is used to drive cap opening and cap sealing mechanisms, which will be described hereinbelow.

Figure 4:
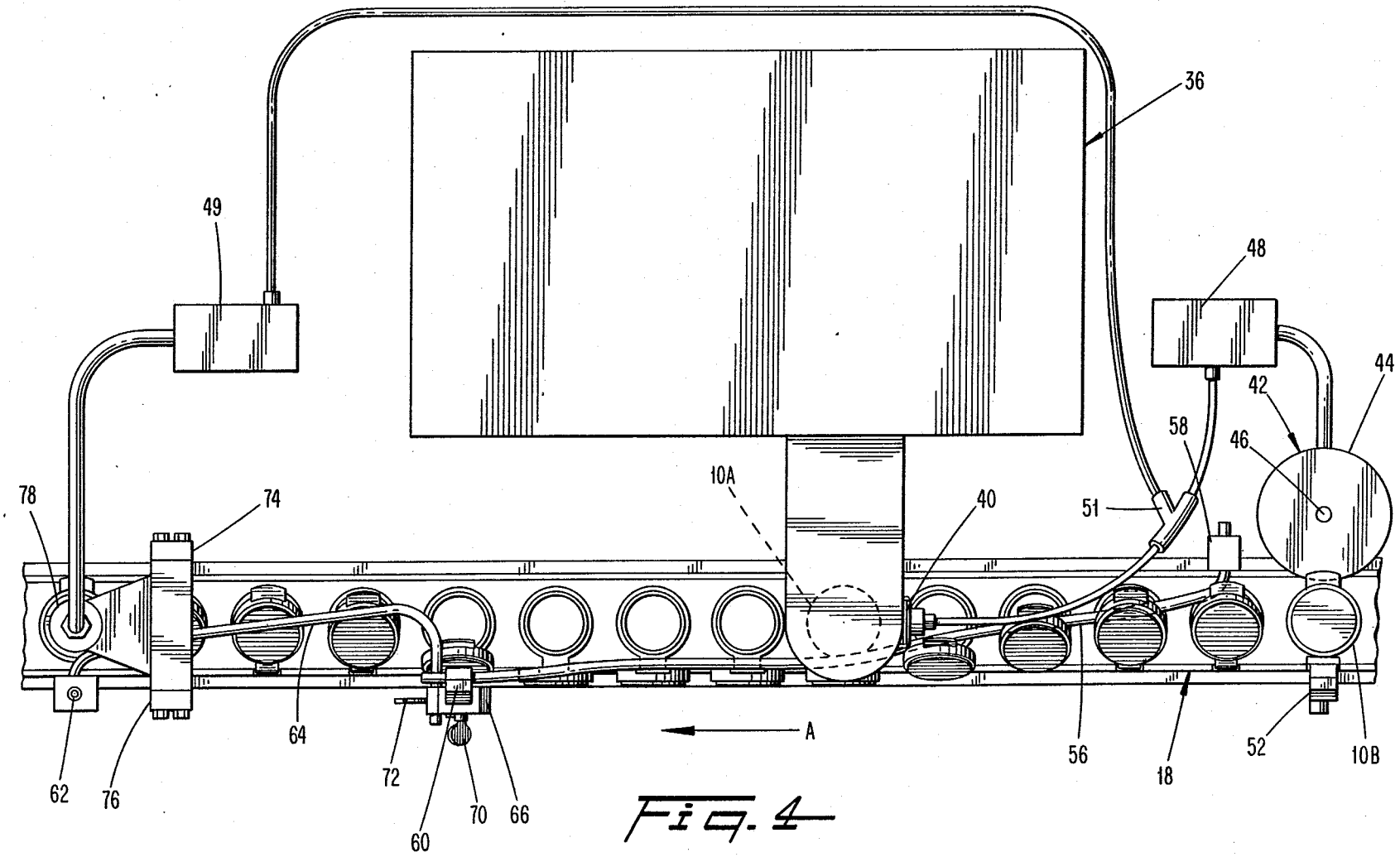
FIG. 4 is a top plan view of the present invention in use with a standard pipette testing apparatus.
Figure 5:
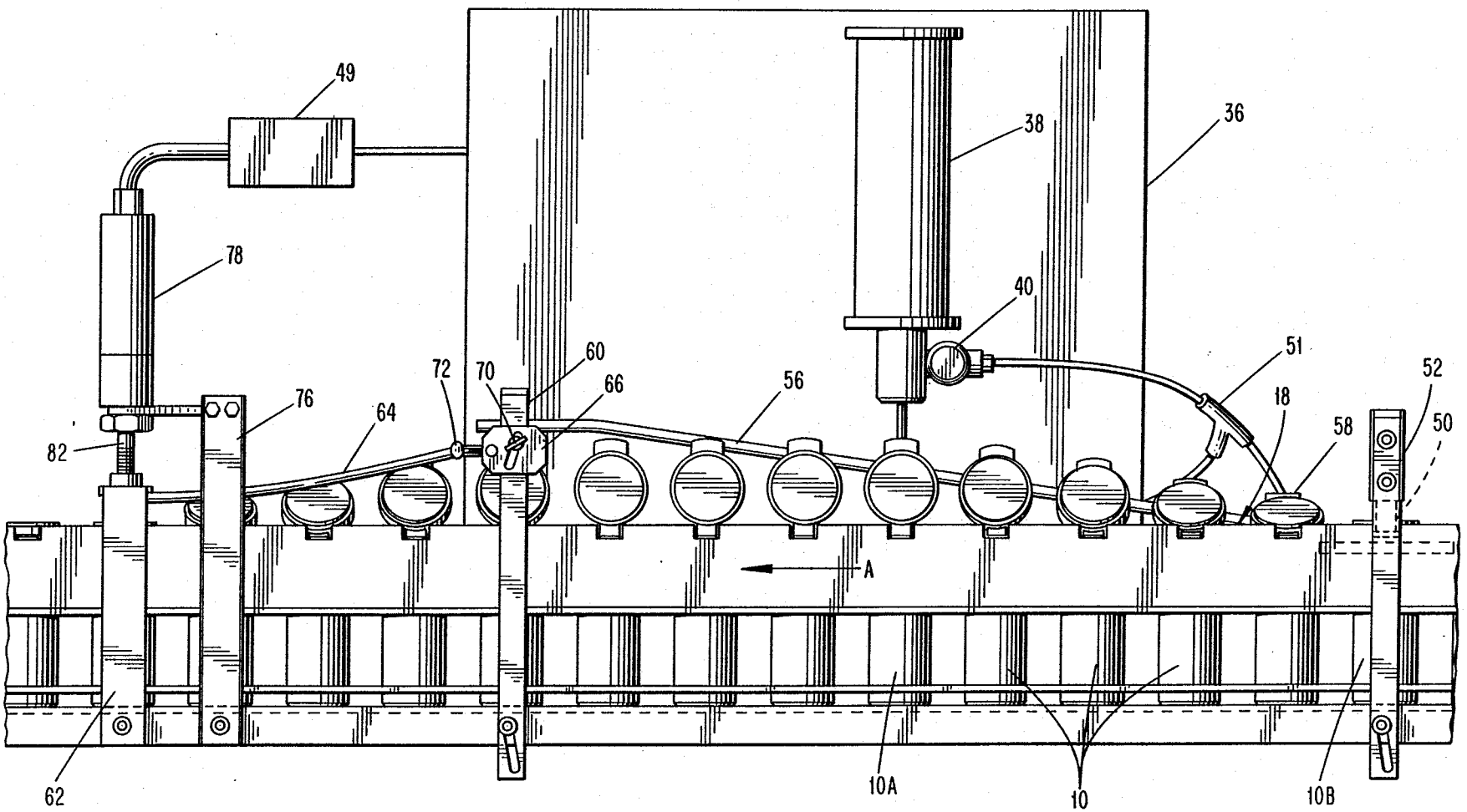
FIG. 5 is a front view of the present invention in use with a standard pipette testing apparatus.
Figure 6:
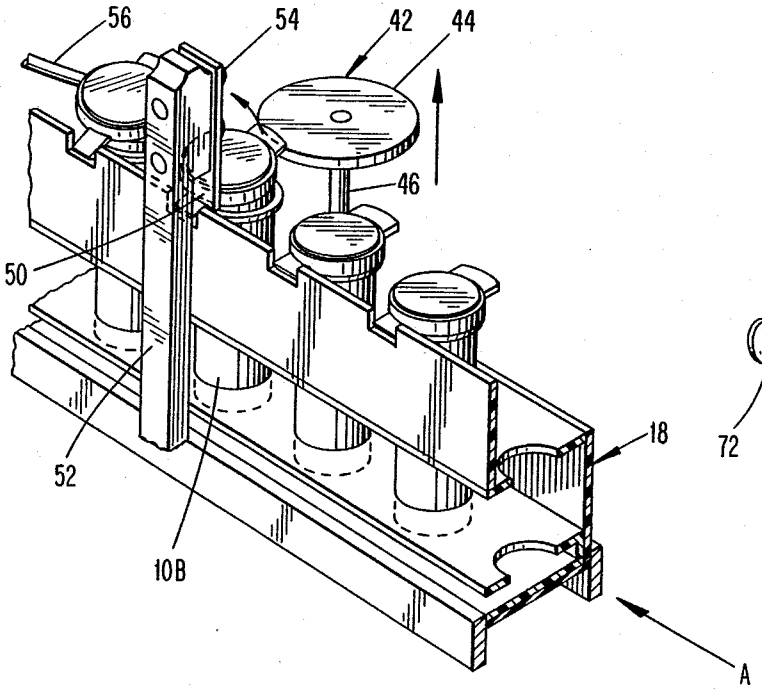

With reference to FIGS. 4–6, a piston operated cap opener 42 is provided adjacent the front wall 22 of the rack 18 at a position equal to approximately five vials upstream of the pipette 38. The cap opener 42 is preferably located upstream of the pipette 38 so that a cap raising mechanism (described hereinbelow) will have time and room to raise the cap away from the vial subsequent to the opening of the vial and prior to its passing beneath the pipette 38. The opener 42 includes a disk 44 mounted on a shaft 46.

The switch 40 and air regulator 48 are operatively connected to the cap opener 42 for raising and lowering the disk 44 of the cap opener 42 upon receipt of a proper signal from the switch 40. In a preferred embodiment of the present invention, the pipette 38, switch 40, and opener 42 are arranged so that when the pipette 38 is lowered into a vial 10A situated directly below the pipette 38, the switch 40 activates the opener 42. The disk 44 is raised and lowered according to pneumatic principles well known to those skilled in the art.

As the pipette 38 is lowered into vial 10A, the disk 44 is quickly raised by the air regulator 48 so that the disk 44 contacts the tab 16 of vial 10B Continued upward movement of the disk 44 unseals the cap 12 from the vial 10B. The opener 42 is preferably operated with about 20 p.s.i. of pressure. During the opening process, the vial is stabilized from tipping by the upper vial supporting surface 24 and the vial base support 26. The vial is also prevented from rotating by the notch 32 in the vial hinge support 28.

With reference to FIG. 6, a support 50 is mounted on a post 52 opposite the vial cap opener 42. The support 50 is adjustably mounted to the post 52 by means of a bolt 54 that extends through an elongated slot (not shown) in the support 50. The support 50 extends over the vials 10 and coacts with the vial hinge support 28 to retain the vials 10 in the vial rack 18 while each vial 10 and cap 12 are being impacted by the vial cap opener 42. The support 50 is suspended directly over the hinge 14 of the vial being acted upon by the vial cap opener 42, and thus prevents upward movement of the vial during the cap opening operation.

The cap raising mechanism mentioned above includes a cap opening rail 56 mounted between a first post 58 and a central post 60. The cap opening rail 56 is arranged to slope upwardly from the first post 58 to the central post 60, and is located such that as the rack 18 and vials 10 contained therein move in front of the testing equipment 36 in the direction of arrow A, the caps 12, which have been unsealed from their respective vials 10 by the vial cap opener 42, are located above the cap opening rail 56. As the vials 10 move along the rail 56, the rail 56 forces the caps 12 into a fully open position, i.e., perpendicular to the top surface of the vial 10, as the vial 10 passes beneath the pipette 38.

As each vial 10, with its cap 12 fully open, passes beneath the pipette 38, the pipette 38 is automatically lowered into the vial 10 in order to undertake the intended testing or manipulation of the vial contents. The timing and operation of the pipette 38 are conducted in accordance with technology and equipment known to those skilled in the art.

In one embodiment of the present invention, a bar code sensor 57 may be located adjacent the cap opening rial 56 for reading and recording bar codes that are printed on each vial. In such a system, the results of the pipette test can be recorded together with a code identifying the particular vial being tested.

A third post 62 is positioned further downstream of the first and central posts 58,60. Arranged between the third post 62 and the central post 60 is a cap closing rail 64. The cap closing rail 64 may be mounted to the posts 60,62 in any conventional manner, but is preferably connected in an adjustable manner via a rail adjusting block 66 to permit use of the invention with vials of different height.

Figure 8:
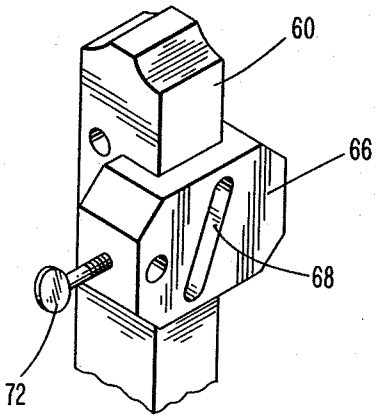
FIG. 8 is a perspective view of a portion of a support post used in the present invention.

With reference to FIGS. 4 and 8, the rail adjusting block 66 has an elongated slot 68 through which a bolt 70 is fastened to the central post 60. The height of the rail adjusting block 66 on the post 60 can be changed by loosening the bolt 70 and moving the block 66 with respect to the post 60 and bolt 70. The cap closing rail 64 is mounted in an opening 67 in the rail adjusting block 66 and is retained therein by a setscrew 72.

With reference to FIG. 5, as each vial 10 approaches the post 60, the tab 16 of the vial passes below the cap opening rail 56. Because the plastic from which the vial and cap are made has a certain amount of resiliency, once the tab 16 is no longer in contact with the cap opening rail 56, the cap moves be lower than the cap closing rail 64 as the vial moves past the post 62. Thus, after the pipette 38 has acted upon a vial 10, the cap 12 of that vial 10 passes below the cap closing rail 64 such that the rail progressively lowers the cap 12 onto the vial 10.

Figure 7:
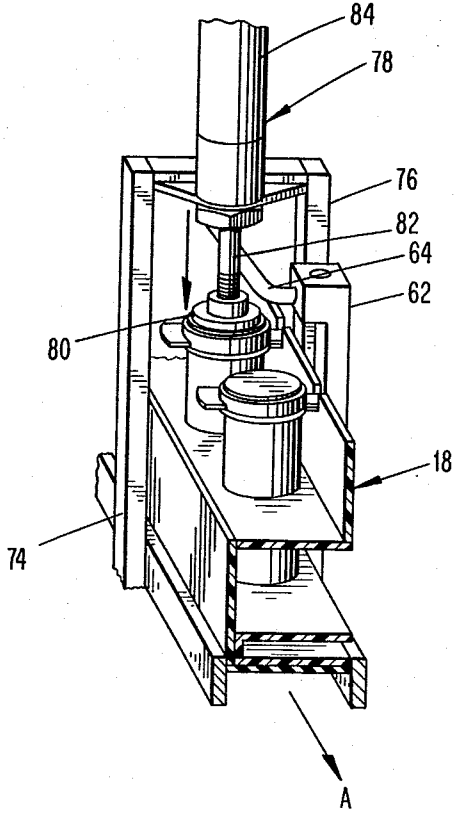
FIGS. 6 and 7 are perspective views of portions of the present invention.

With reference to FIG. 7, further downstream of the third post 62 is a cap closing arrangement. In a preferred embodiment, the cap closing arrangement includes two posts 74,76, arranged on opposite sides of the rack 18. Supported by the two posts 74,76 is a pneumatically operated cap closing piston 78 that is centrally arranged over the rack 18.

The cap closing piston 78 includes a disk 80 mounted on a shaft 82, which is driven by an air cylinder 84. The disk 80 of the cap closing piston 78 is driven vertically onto the caps 12 of the vials 10 passing below. The impact of the disk 80 forces the cap 12 into a tightly sealed position on the vial 10. The cap closing piston is controlled by air regulator 49 and switch 40. The cap closing piston is preferably operated under about 40–45 p.s.i. of pressure.

The timing of the cap closing piston 78 is controlled by the cam operated switch 40 arranged adjacent the pipette 38. The operation of the piston 78 and the switch 40 are in accordance with principles known to the those skilled in the art.

An alternative embodiment of the present invention may be provided that is able to operate with vials wherein the caps are not attached to the vials with a hinge. In such an embodiment, the rack 18 would be modified so as to retain the caps during the period in which the cap is unsealed from the vial. Specifically, instead of having notches 32 for the hinges 14, the vertical wall 30 would have a larger recess, and possibly an additional support to retain the cap 12.

In another alternative use of the present invention, automatic filling equipment is used instead of the testing equipment 36. In such use, the vials are opened by the opening mechanism and filled by the filling equipment and subsequently closed by the apparatus of the present invention.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A device for use in connection with filling or testing equipment for opening and closing snap-on caps on vials adapted for moving sequentially through the device adjacent the filling or testing equipment, said device comprising:

a detachable rack having means for supporting a plurality of vials against rotation and tipping;

piston means for sequentially snapping off a cap from each of the supported vials;

means for raising each cap from its respective vial so as to permit the filling or testing equipment access to the vial;

means for lowering each cap onto its respective vial;

piston means for snapping each cap onto its respective vial;

control means for controlling the operating of both piston means in coordination with the filling or testing equipment; and means for mounting the control means on or adjacent to the filling or testing equipment, the control means including a sensor mounted on or adjacent the filling or testing equipment for sensing when a filling or testing operation occurs and for actuating both piston means substantially simultaneously with the filling or testing operation.

2. The device according to claim 1, wherein the rack includes a notch for supporting the vial against rotation.

3. The device according to claim 1, wherein the means for supporting the vial against tipping includes first and second vertically spaced supporting surfaces having aligned openings for receiving a vial.

4. The device according to claim 1, wherein the piston means for snapping off comprises a pneumatically operated piston means for contacting a portion of each cap to lift it from its respective vial.

5. The device according to claim 1, wherein the raising means comprises a bar mounted adjacent a path, and the device further includes means for causing relative movement between the plurality of vials and the path, said bar sloping upwardly in a downstream direction.

6. The device according to claim 5, wherein the means for causing relative movement between the vials and the path comprises means for moving the supporting detachable rack.

7. The device according to claim 5, wherein said bar is arranged to engage an underside of each vial cap as the vials are moved along the path.

8. The device according to claim 1, wherein the lowering means comprises a bar mounted adjacent a path along which the plurality of vials are moved, said bar sloping downwardly in a downstream direction.

9. The device according to claim 8, wherein said bar is arranged so as to engage a top side of each vial cap as the vials are moved along the path.

10. The device according to claim 8, further comprising means for adjusting the height of the bar.

11. The device according to claim 8, wherein the lowering means is arranged downstream of the raising means.

12. The device according to claim 1, wherein the piston means for snapping off comprises piston means for impacting the cap and urging the cap onto its respective vial.

13. The device according to claim 1, wherein the raising means raises the cap until it is perpendicular to the top surface of the vial.

14. The device according to claim 1, further comprising means for sensing bar codes printed on one of the vial and cap.

15. The device according to claim 1, wherein the supporting means of the detachable rack includes:

a vial supporting surface adapted to support a middle section of the vials; and a vial hinge support wall that includes a plurality of notches for supporting hinges of the vials.

16. A method of opening and closing caps onto vials for use with a device for filling the vials or testing the contents of the vials, comprising the steps of:

locating a plurality of vials in a detachable rack;

sequentially moving said plurality of vials adjacent the filling or testing device;

sequentially unsnapping a cap off of each vial prior to filling or testing;

sequentially raising each cap from its respective vial;

filling the vial or testing the contents of the vial with the filling or testing device while the cap is raised from the vial;

sensing the filling or testing operation with a control means;

sequentially lowering the cap onto its respective vial;

sequentially snapping the cap onto its respective vial; and controlling the snapping and unsnapping operations with said control means such that a cap is unsnapped off of a first vial, a second vial is filled or tested, and a cap is snapped onto a third vial substantially simultaneously.

17. The method according to claim 16, wherein the step of locating the vials in a vial support includes placing the vials into a rack.

18. The method according to claim 17, wherein the step of locating the vials in a vial support further includes stabilizing the vial against rotation and tipping.

19. The method according to claim 16, wherein the step of unsnapping the caps includes impacting the underside of a portion of each cap with a piston to dislodge the cap from its respective vial.

20. The method according to claim 16, wherein the step of raising each cap includes moving the vials adjacent an upwardly sloping bar so as to engage the underside of each cap with the bar.

21. The method according to claim 20, wherein the step of lowering each cap includes moving the vials adjacent a downwardly sloping bar so as to engage the top side of each cap with the bar.

22. The method according to claim 21, wherein the plastic memory of each vial moves the cap in a lowering direction after its contact with the upwardly sloping bar and prior to its contact with the downwardly sloping bar.

* * * * *